US005323505A

United States Patent [19]

Montabaur et al.

[11] Patent Number: 5,323,505

[45] Date of Patent: Jun. 28, 1994

[54] ROTARY BRUSH

[75] Inventors: Werner Montabaur, Königswinter; Detlef Thomas, Cologne, both of Fed. Rep. of Germany

[73] Assignee: Monti-Werkzeuge GmbH, Bonn, Fed. Rep. of Germany

[21] Appl. No.: 19,559

[22] Filed: Feb. 19, 1993

[30] Foreign Application Priority Data

Feb. 21, 1992 [DE] Fed. Rep. of Germany ..... 9202250

[51] Int. Cl.[5] ..... A46B 13/00

[52] U.S. Cl. ..... 15/179

[58] Field of Search ..... 15/23, 88.3, 88.4, 179, 15/230, 230.14, 230.16, 230.19; 51/334

[56] References Cited

U.S. PATENT DOCUMENTS

| | | | |
|---|---|---|---|
| 911,702 | 2/1909 | Carroll | 15/179 |
| 1,482,744 | 2/1924 | Heffernan | 15/179 |
| 1,867,728 | 7/1932 | Card, Jr. | 15/179 |
| 4,365,448 | 12/1982 | Wilson | 51/334 |

FOREIGN PATENT DOCUMENTS

| | | | |
|---|---|---|---|
| 534418 | 12/1956 | Canada | 15/179 |
| 1068581 | 2/1954 | France | 15/179 |

*Primary Examiner*—Harvey C. Hornsby

*Assistant Examiner*—Mark Spisich

*Attorney, Agent, or Firm*—Herbert Dubno; Andrew Wilford

[57] ABSTRACT

A brush assembly adapted to be rotated about an axis has a brush having a flexible, annular and generally cylindrical collar generally centered on the axis and having a predetermined and generally uniform radial thickness, a predetermined inside diameter, and a predetermined axial length, and a plurality of arrays of radially projecting bristles angularly equispaced about the collar and defining a plurality of axially throughgoing and angularly equispaced bristle-free zones. A holder drum has a core having an outer surface centered on the axis and having a predetermined outside diameter substantially smaller than the inside diameter of the collar, inner and outer end flanges axially flanking the core paced axially apart by a predetermined axial distance greater than the axial length of the collar so that the collar is received with axial play between the flanges, and respective retaining tongues extending axially between the flanges in the bristle-free zones of the brush. The tongues have inner surfaces spaced radially outward from the outer surface of the core body by a radial spacing substantially greater than the radial thickness of the collar so that the collar is received with radial play between the surfaces and the tongues.

2 Claims, 2 Drawing Sheets

ROTARY BRUSH

FIELD OF THE INVENTION

The present invention relates to a brush. More particularly this invention concerns a brush that is rotated about an axis when used.

BACKGROUND OF THE INVENTION

A standard rotary brush assembly has a flexible, annular and generally cylindrical collar generally centered on the axis and having a predetermined and generally uniform radial thickness, a predetermined inside diameter, and a predetermined axial length. A plurality of arrays of radially projecting bristles angularly equispaced about the collar define a plurality of axially throughgoing and angularly equispaced bristle-free zones. A holder for the brush is comprised of a pair of flange disks each formed with a circular groove of the same diameter as the brush collar, a central screw spindle extending between the disks, and axially projecting tongues radially outside the grooves and spaced to engage in the bristle-free zones of the brush. The axial ends of the collar are fitted in the grooves of disks with the tongues positioned in the bristle-free zones, and the screw is tightened to clamp the brush in place.

This assembly is structurally very stable so that when it is rotated the outer ends of the bristles can be counted on to lie on a cylinder centered on the rotation axis of the brush, and the tongues prevent the brush from coming loose even if stressed considerably.

While this arrangement is fairly effective, it is susceptible of improvement.

OBJECTS OF THE INVENTION

It is therefore an object of the present invention to provide an improved rotary brush assembly.

Another object is the provision of such an improved rotary brush assembly which is more effective than the prior-art systems and that is cheaper to manufacture.

SUMMARY OF THE INVENTION

A brush assembly adapted to be rotated about an axis has according to the invention a brush having a flexible, annular and generally cylindrical collar generally centered on the axis and having a predetermined and generally uniform radial thickness, a predetermined inside diameter, and a predetermined axial length, and a plurality of arrays of radially projecting bristles angularly equispaced about the collar and defining a plurality of axially throughgoing and angularly equispaced bristle-free zones. A holder drum has a core having an outer surface centered on the axis and having a predetermined outside diameter substantially smaller than the inside diameter of the collar, inner and outer end flanges axially flanking the core and spaced axially apart by a predetermined axial distance longer than the axial length of the collar so that the collar is received with axial play between the flanges, and respective retaining tongues extending axially between the flanges in the bristle-free zones of the brush. The tongues have inner surfaces spaced radially outward from the cylinder of the core body by a radial spacing substantially greater than the radial thickness of the collar so that the collar is received with radial play between the inner surfaces and the tongues.

When such a brush is rotated it has been found that the brush collar bulges outward between the tongues, creating lobes that give the normally cylindrical outer surface of the brush a lobular shape that causes the bunches of bristles to strike the object being abraded in a pulsating or vibratory manner, unlike the continuous rubbing of the prior art. This vibration gives substantially greater abrasion, making the system of this invention much more effective than the prior-art systems.

According to another feature of the invention the holder drum is formed by a pair of identical parts each forming a respective one of the flanges, half of the core, and half of each of the tongues. The drum further has according to the invention means for releasably securing the parts axially together, typically a threaded spindle or screw bracing the two halves axially together.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
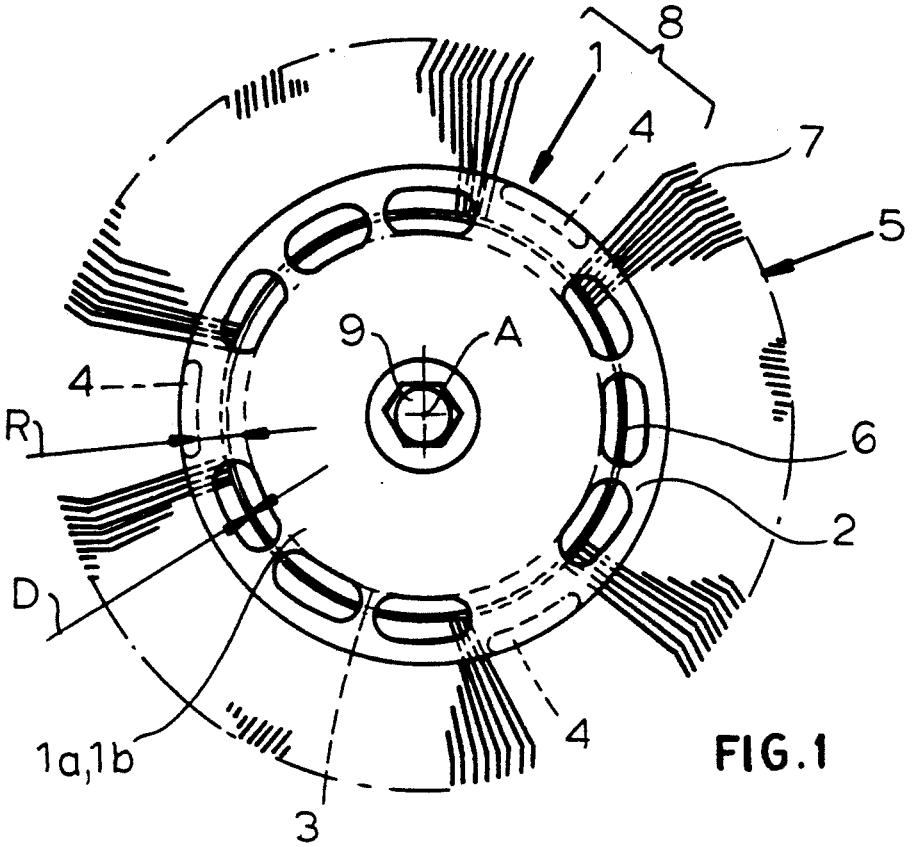
FIG. 1 is an end view of the brush according to the invention.
Figure 2:
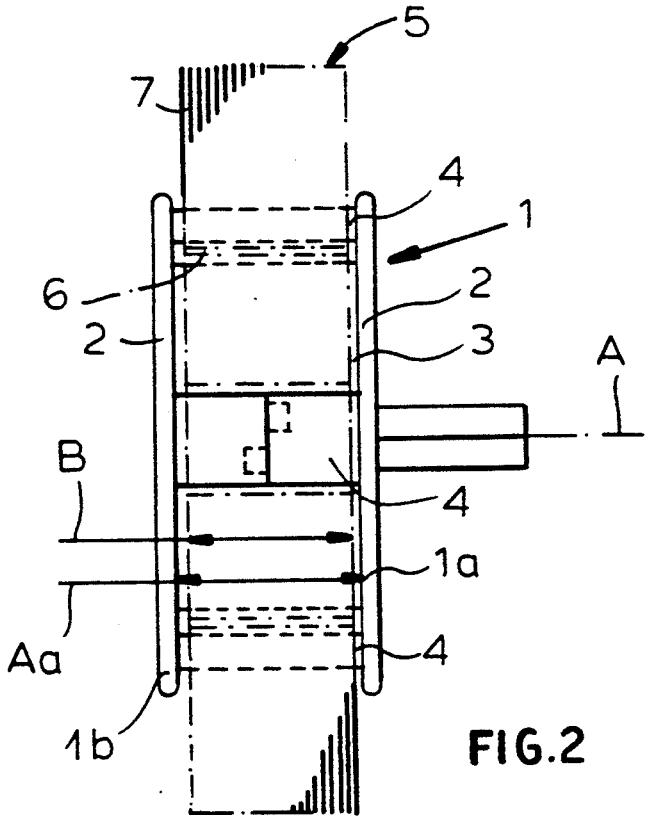
FIG. 2 is an axial section through the brush.
Figure 3:
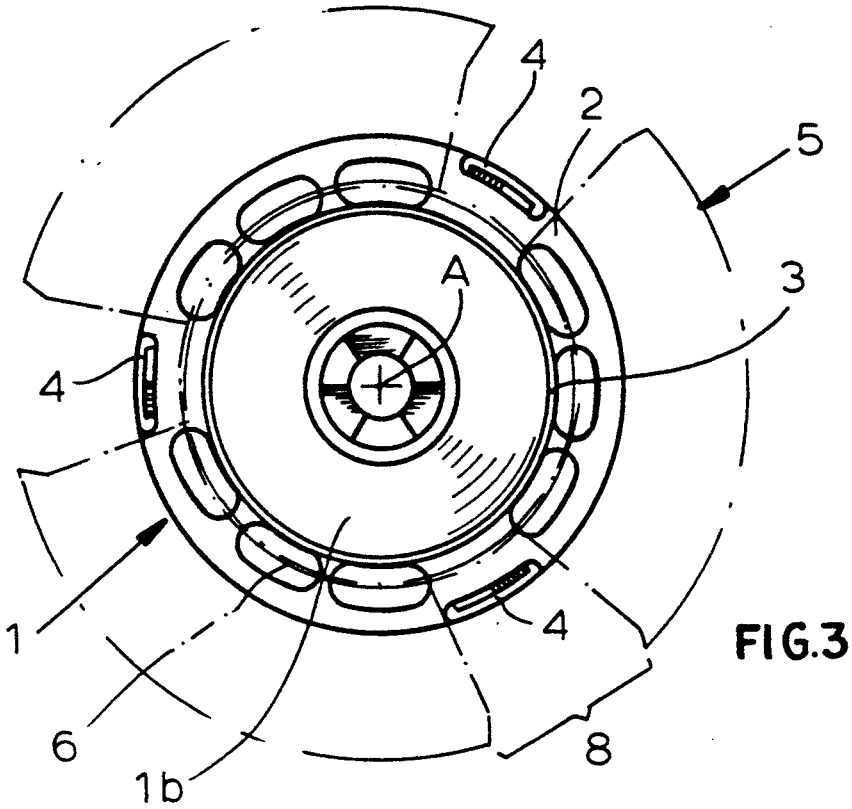
FIG. 3 is an end view of the brush with one flange plate removed.

As seen in FIG. 1 a brush assembly according to the invention basically comprises a holder drum 1 and a brush 5, both centered on an axis A about which the assembly 1, 5 is rotated when in use. Both the drum 1 and brush 5 are symmetrical with respect to the axis A.

The brush 5 comprises a cylindrical collar 6 of a flexible elastomer having an axial length B. This collar 6 carries three bunches 7 of radially outwardly projecting identical bristles that are angularly equispaced about the axis A and separated by axially throughgoing bristle-free zones 8. The bristles can be of wire, a synthetic or natural material, or even of glass, depending on the application to which the brush is to be put. There may be more or less than three such bunches 7 of bristles, but the zones 5 are normally angularly equispaced.

The drum 1 is formed of a pair of identical drum parts 1*a* and 1*b* forming a rigid cylindrical core 3 of an outside diameter substantially smaller than an inside diameter of the collar 6 and a pair of planar flange disks 2 spaced apart by a distance Aa substantially longer than the axial length B. In addition tongues 4 extend in the zones 8 between the two disks 2 and are spaced outward from the core 3 by a distance R equal to a multiple of the radial thickness of the collar 6. A threaded bolt 9 is threaded axially between the two drum parts 1*a* and 1*b* and can serve as a mandrel for mounting the brush in a drill chuck.

Figure 4:
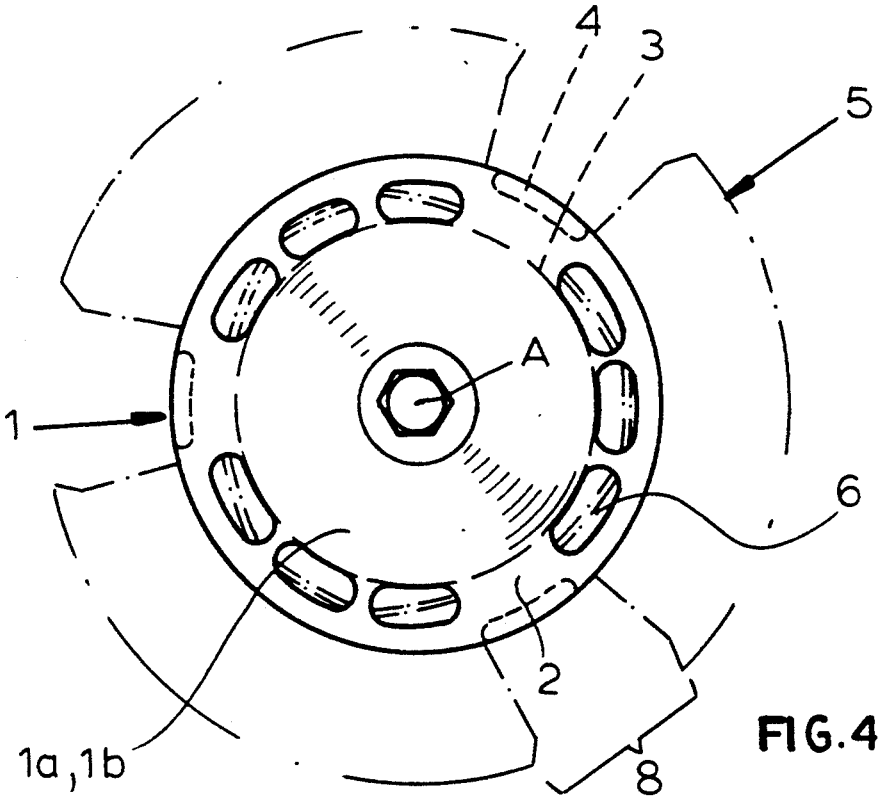
FIG. 4 is a side view illustrating the shape of the brush when in use.

Thus the collar 6 is received with axial and radial play in a cage defined axially between the flange disks 2 and radially between the core 3 and tongues 4. As a result as shown in FIG. 4 when rotated at high speed it will bulge radially outward between the tongues 4 and will assume a lobular shape. Hence the article being abraded by the bristle bunches 7 will be engaged in a pulsating or vibrating manner and will be abraded much more rapidly than by a prior art system with uniform engagement.

We claim:

1. A brush assembly adapted to be rotated about an axis, the assembly comprising:

a brush having a flexible, annular and generally cylindrical collar generally centered on the axis and having a predetermined and generally uniform radial thickness, a predetermined inside diameter, and a predetermined axial length, and a plurality of arrays of radially projecting bristles angularly equispaced about the collar and defining a plurality of axially throughgoing and angularly equispaced bristle-free zones; and a holder drum having a core generally coaxially surrounded by the collar, having a generally cylindrical outer surface centered on the axis and having a predetermined outside diameter substantially smaller than the inside diameter of the collar, inner and outer end flanges axially flanking the core and spaced axially apart by a predetermined axial distance greater than the axial length of the collar, whereby the collar is received with axial play between the flanges, and respective retaining tongues axially bridging between and axially interconnecting the flanges in the bristle-free zones of the brush radially outside the collar, the tongues having inner surfaces extending axially the distance between the flanges and spaced radially outward from the cylindrical outer surface of the core by a radial spacing substantially greater than the radial thickness of the collar, whereby the collar is received with radial play between the inner surface of the core and the inner surfaces of the tongues and is adapted to bulge radially outward between the tongues when the assembly is rotated at high speed.

2. A brush assembly adapted to be rotated about an axis, the assembly comprising:

a brush having a flexible, annular and generally cylindrical collar generally centered on the axis and having a predetermined and generally uniform radial thickness, a predetermined inside diameter, and a predetermined axial length, and a plurality of arrays of radially projecting bristles angularly equispaced about the collar and defining a plurality of axially throughgoing and angularly equispaced bristle-free zones;

a holder drum having a core generally coaxially surrounded by the collar, having a generally cylindrical outer surface centered on the axis and having a predetermined outside diameter substantially smaller than the inside diameter of the collar, inner and outer end flanges axially flanking the core and spaced axially apart by a predetermined axial distance greater than the axial length of the collar, whereby the collar is received with axial play between the flanges, and respective retaining tongues extending axially between the flanges in the bristlefree zones of the brush radially outside the collar, the tongues having inner surfaces spaced radially outward from the cylindrical outer surface of the core by a radial spacing substantially greater than the radial thickness of the collar, whereby the collar is received with radial play between the outer surface of the core and the inner surfaces of the tongues and is adapted to bulge radially outward between the tongues when the assembly is rotated at high speed, the holder drum being formed by a pair of identical parts each forming a respective one of the flanges, half of the core, and half of each of the tongues; and means for releasably securing the parts axially together.

* * * * *